US005233499A

United States Patent [19]

Twerdochlib

[11] Patent Number: 5,233,499

[45] Date of Patent: Aug. 3, 1993

[54] AUTOMATIC SHAFT GROUND CONDITIONER

[75] Inventor: Michael Twerdochlib, Oviedo, Fla.

[73] Assignee: Westinghouse Electric Corp., Pittsburgh, Pa.

[21] Appl. No.: 747,821

[22] Filed: Aug. 21, 1991

[51] Int. Cl.[5] ..... H05F 3/00

[52] U.S. Cl. ..... 361/212; 361/221

[58] Field of Search ..... 361/212, 220, 221; 340/648, 649, 679, 682

[56] References Cited

U.S. PATENT DOCUMENTS

| | | | |
|---|---|---|---|
| 4,307,432 | 12/1981 | Nishikawa | 361/221 |
| 4,831,295 | 5/1989 | Posdel | 361/212 |
| 4,873,512 | 10/1989 | Miller | 340/679 |
| 4,939,506 | 7/1990 | Gram | 361/212 |

*Primary Examiner*—Jeffrey A. Gaffin

*Attorney, Agent, or Firm*—Michael G. Panian

[57] ABSTRACT

Apparatus for automatically cleaning shaft grounding devices in rotating machinery to reduce or eliminate the need for on-line servicing of the grounding devices. When a monitoring system for the grounding devices signals that an excessive electrical charge is present on the shaft, a cleansing material is sprayed at the interface of the grounding device with the shaft to remove any contaminants for the electrical insulating material between the bearings and the rotating shaft, and to re-establish the grounding path from the shaft. Voltage discharge from the shaft to the bearings through the bearing lubricating oil is thereby prevented. Alarm delay of the shaft ground monitoring device allows the apparatus to function automatically, obviating the need for on-servicing by plant personnel or unnecessary shut down of the machinery.

18 Claims, 4 Drawing Sheets

AUTOMATIC SHAFT GROUND CONDITIONER

FIELD OF THE INVENTION

The invention generally relates to apparatus for electrically grounding a portion of rotating machinery during use, and more particularly to a shaft ground conditioning system to eliminate fouling of the shaft grounding apparatus.

BACKGROUND OF THE INVENTION

The rotating steel shafts of large turbine-generators must be continuously grounded to prevent damage to shaft bearings from electrostatic and dissymmetry voltages. Operation of this rotating machinery can result in electrical charge buildup on the rotor or shaft, which is supported at spaced-apart locations by the bearings. Electrostatic charges can be transferred to the rotating system by small water particles within the low-pressure turbine; dissymmetry voltages may be generated within the generator shaft by magnetic irregularities in the stator core. The shaft itself actually rides on a thin film of oil or other suitable lubricant in the bearing, and accordingly is electrically insulated from ground potential. The buildup of an excessive electrical charge on the shaft can cause a discharge through the oil film, resulting in damage to the bearings.

In order to prevent such discharge, and in order to ground the rotating shaft, shaft grounding devices (SGD) are placed in continuous contact with the rotating shaft as it rotates, to afford a discharge path to ground through the bearing pedestals for the electrical charge buildup. Typically, these devices are placed between the last low-pressure turbine and the generator. The SGD functions by draining electrostatic charge to the frame, and confine dissymmetry voltages to that part of the rotating shaft within the generator and exciter. The generator and exciter bearings are protected from the destructive effects of dissymmetry voltages by being insulated from the system frame. During the operating life of the grounding device, an insulating film buildup may occur, thereby interrupting the continuous path to ground for, the electrical charge. A voltage builds up on the shaft to a certain threshold value whereby discharge through the oil film takes place, which can lead to bearing damage. When the SGD fails to make effective and continuous contact with the shaft, problems such as bearing and journal pitting can reduce bearing life.

Maintaining effective, long-term contact is difficult because of the high surface velocity of the steel shaft, and contamination to the shaft by oil, water droplets and dirt. Because of this likelihood of damage to the bearings, frequent periodic inspections of the SGDs have been required in the past.

To reduce the manpower required for these periodic maintenance inspections, on-line monitoring systems have been used to monitor shaft voltage, or to detect electrical discharge which may occur and which is a symptom of poor shaft grounding. Recently, an active shaft grounding system has been adopted, which reduces SGD service required by actively compensating for voltage developed across the shaft SGD interface. The active shaft grounding system compensates for poor contact at the SGD-to-shaft interface, but on-line service may still be required when this voltage exceeds the limit of the active shaft grounding system active drive circuit. Also, contamination of the oil film can also render the active shaft grounding system unable to effectively do its intended purpose. The active shaft grounding system is disclosed in U.S. Pat. No. 4,873,512 issued on Oct. 10, 1989, to Miller, and assigned to the present assignee. The Miller patent is hereby incorporated by reference.

The continuing need for on-line service between periodic maintenance inspections is of concern, because of the high speed of the rotating shaft and the typically hot, oily environment of the confined work space where the SGDs are located within the turbine-generator system. Thus, it is desirable that entry by plant personnel into this area be kept to a minimum.

It is therefore an object of the present invention to provide an automatic means to re-establish shaft grounding in the case of shaft grounding device fouling.

It is a further object of the present invention to prevent bearing damage by electrical discharge from the shaft through the oil film to the bearings.

It is a further object of the present invention to minimize entry of plant personnel into the hostile environment of an operating turbine-generator system.

SUMMARY OF THE INVENTION

The above objects are attained by the present invention, according to which, briefly stated, an active shaft grounding system comprises a rotating assembly having a shaft rotatable relative to a stationary assembly and subject to an electrical buildup during rotation, the shaft being supported by spaced-apart bearings having a lubricant thereon such that the shaft is electrically insulated from the bearings, and the grounding system further comprises grounding means for maintaining the shaft at substantially ground potential and means for automatically conditioning the grounding means whereby an electrical discharge is prevented from occurring between the shaft and the bearings.

BRIEF DESCRIPTION OF THE DRAWINGS

Various other objects, features, and advantages of the invention will become more apparent by reading the following detailed description in conjunction with the drawings, which are shown by way of example only, wherein:

FIG. 2A shows a prior art grounding device comprised of a pair of electrically conducting brushes;

FIG. 2B shows a prior art grounding device comprising a braided copper strap;

FIG. 2C shows a prior art active shaft grounding device wherein a feedback circuit provides a neutralizing current to minimize electrical charge buildup on a rotating shaft;

DESCRIPTION OF THE PREFERRED EMBODIMENTS

Figure 1A:
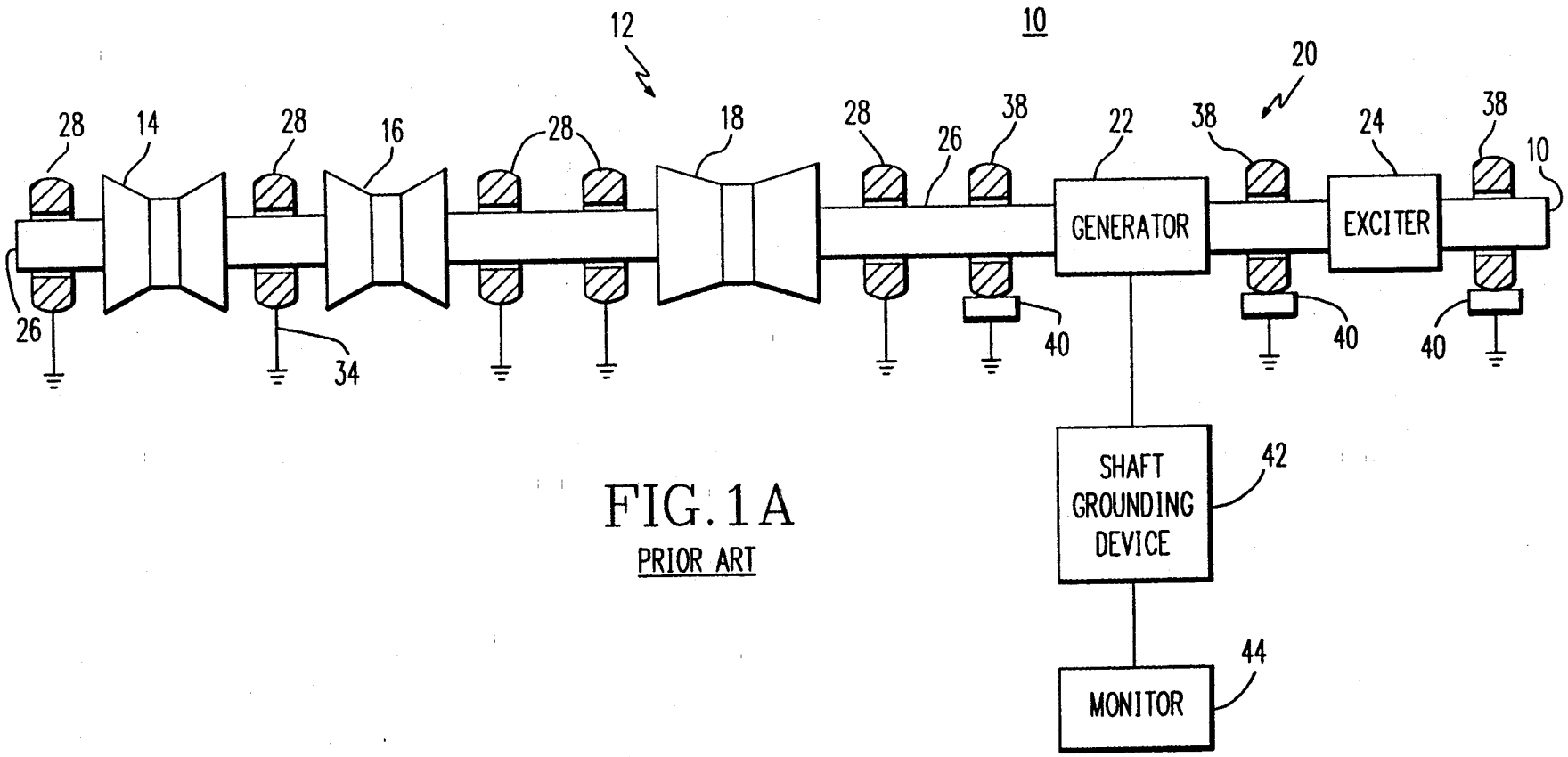
FIG. 1A PRIOR ART
FIG. 1A is a representation of rotating machines, such as a turbine-generator system, supported by bearings.
Figure 1B:
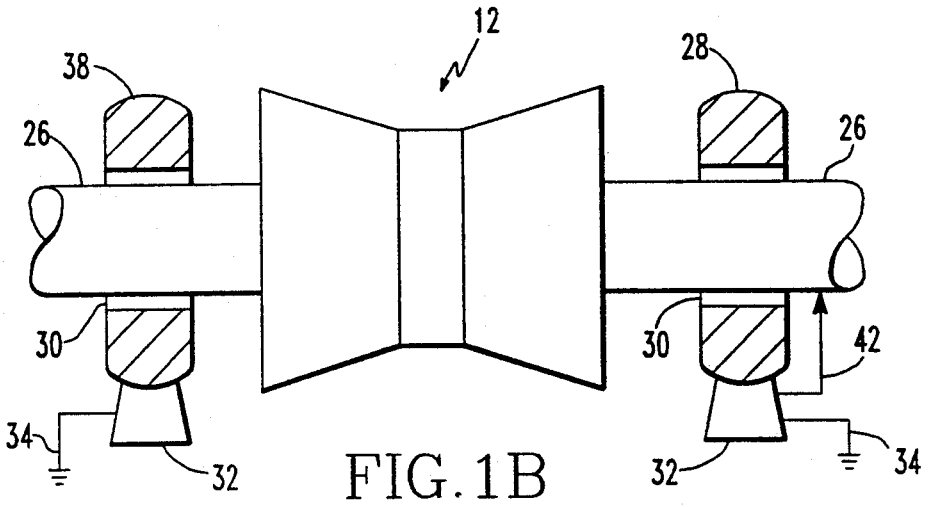
FIG. 1B PRIOR ART
FIG. 1B is an enlarged portion of FIG. 1A.

Referring now to the drawings in detail, wherein like numerals are utilized for the indication of similar elements throughout the drawings, FIG. 1A is a simplified representation of the steam turbine-generator portion of a power plant 10. The steam portion 12 of the system consists of a high-pressure turbine 14, an intermediate-pressure turbine 16, and a low-pressure turbine 18. The electrical portion 20 of the system includes a generator 22 and an exciter 24 which applies DC current to the generator rotor coils (not shown). Components are coupled to a common shaft 26 which, in the steam portion 12, are supported by bearings 28. The bearings 28 are of the type whereby the shaft 26 is supported and rotates on a thin film of oil, as depicted by numeral 30 (FIG. 1B), in the bearing 28, with the oil film 30 providing for electrical isolation between the shaft 26 and bearings 28. The bearings 28 themselves are supported on respective. pedestal structures 32 which, from an electrical standpoint, are at ground potential 34.

Due to its operating environment, the shaft 26 tends to build up an electrostatic charge which, in the case of a steam turbine 12, is due to electron deposition from water droplets impinging on the turbine rotor 26 during operation. Since the rotating shaft 26 is electrically isolated from the stationary portion of the machinery, a potentially damaging voltage differential may build up across the oil films 30. When the electrical rating of the thin film of oil is exceeded, an electrical discharge may take place therethrough, causing an arc-over which, if continued, may result in burning of the lubricating oil, pitting, turbulence, and eventual bearing failure. Typically, the rotor in the electrical portion 20 of the system is supported by bearings 38 which are not electrically connected to ground but are insulated therefrom by an electrical insulation 40. In the electrical portion 20 of the system, dissymmetry voltages may occur within that portion of the shaft 26 due to magnetic irregularities in the stator core.

Figure 2A:
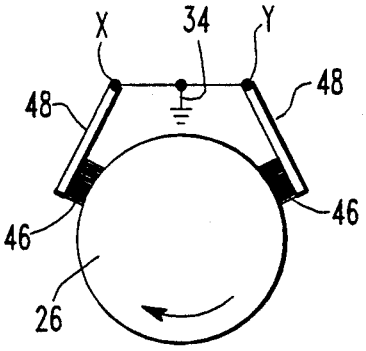
FIG. 2A PRIOR ART
FIGS. 2A, 2B and 2C, a represent typical shaft grounding devices of the p for the machine of FIG. 1.
Figure 2C:
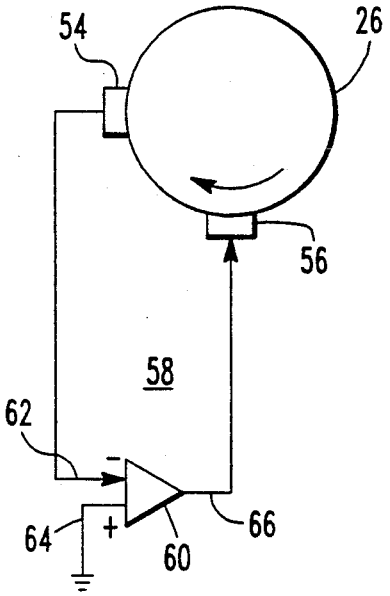
FIG. 2C PRIOR ART
Figure 2B:
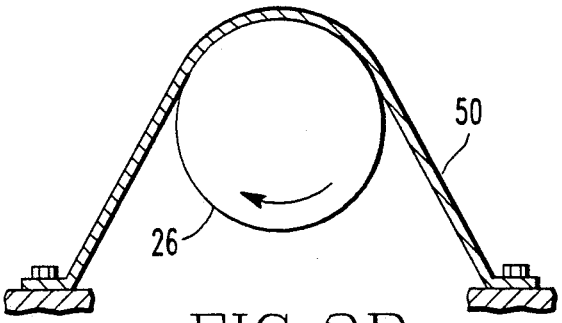
FIG. 2B PRIOR ART

In order to eliminate this condition, means 42 are provided for maintaining the shaft 26 at substantially ground potential. As shown in FIG. 1A, this is accomplished with the provision of a shaft grounding device (SGD) 42 electrically connecting shaft 26 to the pedestal structure 32 or any other stationary portion of the turbine-generator system 10 at ground potential, so as to establish an electrical current discharge path between the rotary and stationary portions of the turbine for electrostatic charging and confine dissymmetry voltage to the generator shaft which has insulated bearing pedestals. By way of example, these typical grounding arrangements are shown in FIGS. 2A, 2B, 2C. The monitoring system 44 for a typical SGD 42 transmits a shaft 26 voltage alarm to the power plant control room when an excess voltage is detected.

In FIG. 2A the grounding device 42 is comprised of a pair of electrically conducting brushes 46, such as carbon graphite brushes, carried by respective brush holders pivotable around points X, Y, or free to slide in a box (not shown). The brushes 46 are typically spring-loaded against the rotating shaft 26 and are electrically connected to ground, indicated by a numeral 34, so that any electrostatic charge buildup on the turbine shaft 26 may be carried to ground via the brushes 46 and holders 48.

Another type of grounding device 42 is illustrated in FIG. 2B and includes a grounding strap 50 of metallic, typically copper, braid which electrically contacts the shaft 26 as well as ground 34. With these types of grounding arrangements 42, an imperfect electrical contact may exist between the shaft 26 and conducting brushes 46 or strap 50, thus resulting in a shaft voltage which may exceed a threshold voltage at which static discharge occurs. This threshold voltage may vary with bearing clearance and oil contamination. Thus, with the provision of a grounding device 42, periodic electrical discharge and arcing through the bearing oil film 30 may occur, resulting in bearing 28 damage.

FIG. 2C shows one embodiment of an active shaft grounding system 52 described in U.S. Pat. No. 4,873,512. This system is designed to actively maintain the shaft 26 to ground, or substantially ground, potential to prevent arc discharges from the shaft 26 to a stationary portion of the machine. In the arrangement of FIG. 2C, a first electrical contact device 54 in the form of a brush, as well as a second electrical contact device 56 in the form of a second brush, both making contact with shaft 26 as it rotates. Connected between the first and second brushes 54,56 is a feedback circuit 58 which provides a neutralizing current at the second brush 56 to prevent or minimize any electrical charge buildup on the shaft 26, as a function of the voltage appearing at the first brush 54. More particularly, the feedback circuit 58 includes an operational amplifier 60 having a first or inverting input 62 connected to receive the voltage at the first brush 54, and the second or non-inverting input 64 connected to a reference potential illustrated as ground. The output 66 of the operational amplifier is connected to the second brush 56 and delivery of the neutralizing current. With a high open loop gain of the operational amplifier 58, the shaft 26 will be maintained at near ground potential. Even though the active shaft grounding system 52 compensates for poor contact at the SGD 42 to shaft 26 interface, on-line service may still be required when the film builds to a high level, requiring excessive circuit drive voltage that exceeds the limits of the active drive circuit. From testing, it has been learned that this can occur given sufficient passage of time. This fouling can occur more quickly should the shaft oil system leak, thus placing oil on the shaft.

Figure 3:
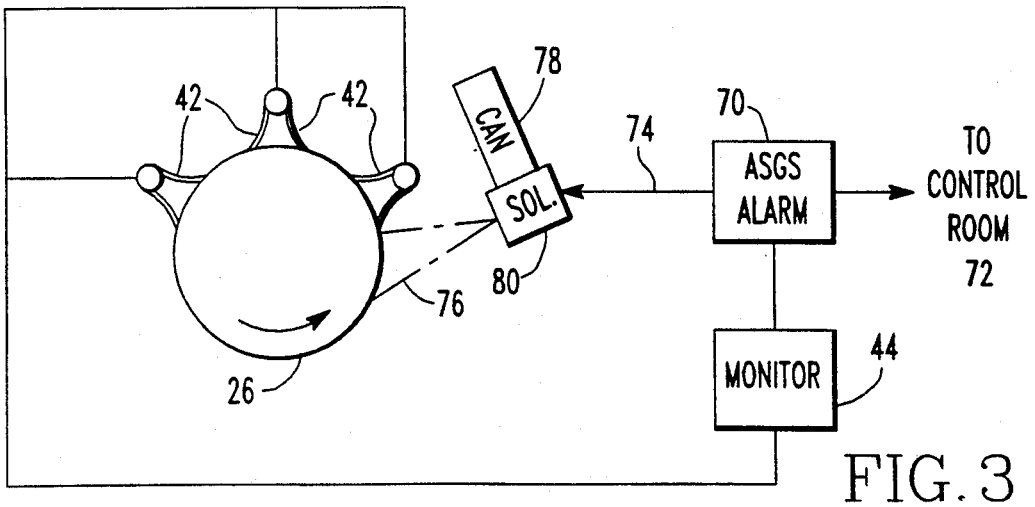
FIG. 3 shows the present invention integrated into a shaft grounding device.

In now referring to FIG. 3, the present invention comprises an automatic shaft ground conditioner 68 to eliminate the need for on-line SGD 42 servicing by plant personnel. The present invention is designed to work in conjunction with the active shaft grounding system or other on-line SGD monitoring systems 44. When the monitoring system 44 for the SGD 42 issues a shaft voltage alarm 70, the device 68 delays the alarm transmission to the power plant control room 72 for a period of time, on the order of about a minute, while the device 80 is actuated by a signal 74 to automatically apply a burst of de-greaser spray 76, or other cleansing material, to the SGDs 42 and shaft 26. In the preferred embodiment shown in FIG. 3, an aerosol can 78 is fitted with a solenoid actuator 80 and mounted such that the spray 76 is directed to the SGDs 42. A small spray of de-greaser 76, such as trichloroethylene, is applied to the shaft 26 in front of the SGDs 42 (e.g., copper braids or brushes) to eliminate fouling and to re-establish shaft ground. The spray 76 dissolves the shaft film and washes away any accumulation on the braids or copper brushes. Since the actual cause of SGD 42 fouling typically cannot be addressed on-line, re-fouling may recur;

and the device 68 is capable of periodically repeating its de-fouling operation. In operation, the alarm delay enables the device to function automatically, without the intervention of control room service or maintenance personnel. If the supply of de-greaser should be exhausted before scheduled replacement (i.e., during a planned plant outage), the device alarm delay is configured to timeout with the alarm 70 still active, and thus the alarm signal would be transmitted to the control room 74, as is presently the case.

In situations where a relatively large amount of water or oil may be present on the shaft 26, the de-greaser spray 76 is effective in re-establishing nearly perfect shaft grounding when applied manually to the SGDs 42. With carbon and braid-type grounding devices, which are generally fouled over a longer period of time, the de-greaser spray 76 is also effective in these situations as well. Thus, the disclosed device provides an automatic means of re-establishing a ground following detection by the shaft monitor 44 of an excess voltage condition, thus making these prior art instruments proactive. These intermittent problems, due to oil and/or dirt contamination of the SGDs, are solved without sounding an alarm 70. Thus, continuous operation of the SGD 42 is provided for, thereby preventing bearing 28,38 damage. More importantly, it obviates the need for power plant maintenance personnel to service the SGD on-line in the generally hostile environment of the turbine-generator system. Hence, reliability of the active shaft grounding system or other on-line shaft ground systems and shaft grounding devices are improved through the use of the present invention.

Figure 4:
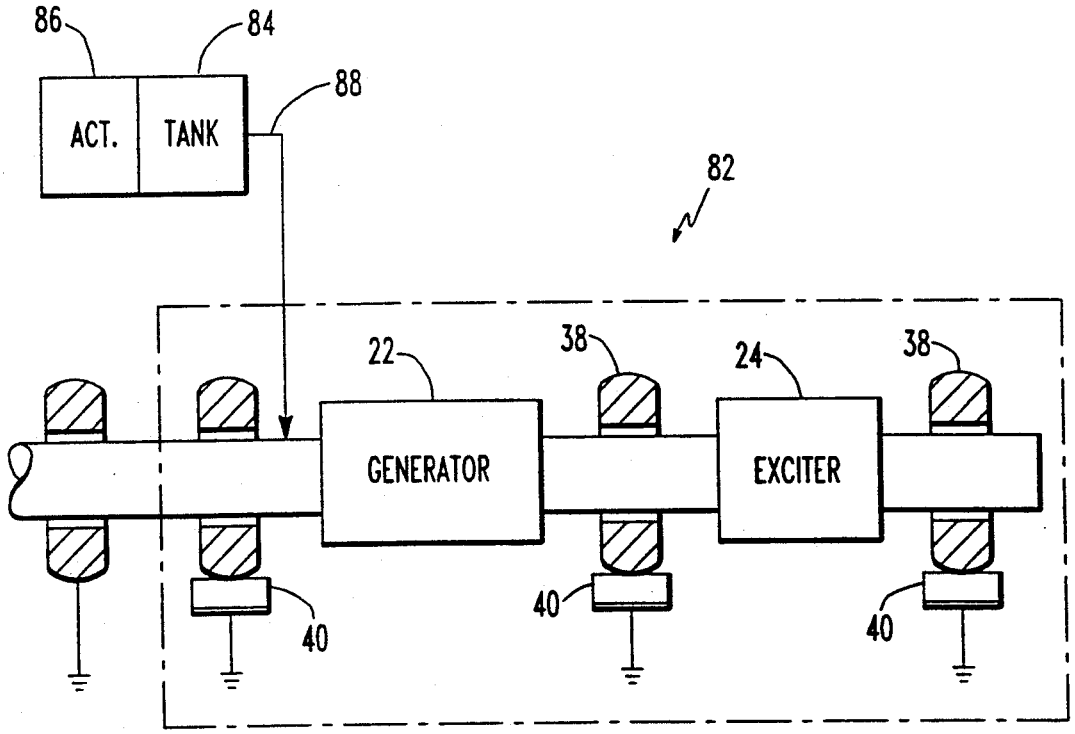
FIG. 4 shows a second embodiment of the present invention.

In a second embodiment of the present invention, as shown in FIG. 4, a tank 84 or other similar device holding a relatively large supply of the de-greaser 76 is provided external to the enclosed electrical portion, the tank 84 also having an actuator 86 associated therewith. The actuator 86 is electrically connected to the SGD 42 as in the previous embodiment above. An inlet line or conduit 88 is provided into the system to apply de-greaser spray 76 to the desired portion in front of the SGDs 42. Thus, should the supply of the de-greaser within the tank 84 be exhausted during normal operation, the automatic shaft ground conditioner 82 can be re-supplied external to the environment of the generator-exciter system.

Figure 5:
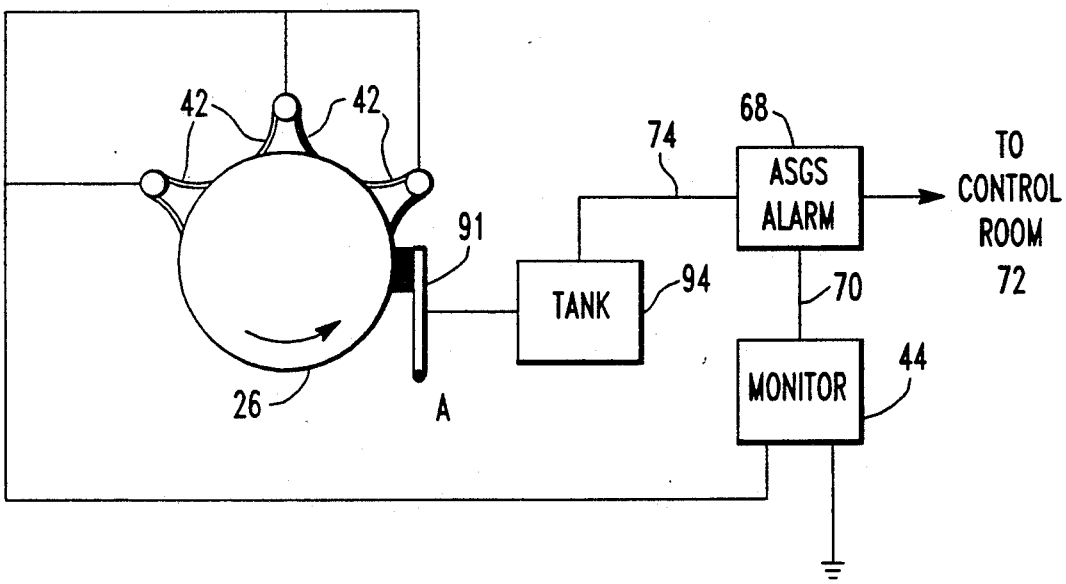
FIG. 5 is a representation of a third embodiment of the invention.

FIG. 5 shows a third embodiment of the present invention. A wiper arm or brush 91, or other means for applying the de-greaser, as represented at 94, the brush representing the preferred means directly to the shaft 26, is pivotable about axis A. When the monitor 44 detects an excessive voltage condition, an amount of de-greaser is applied to the brush 91 and an actuator causes the brush to pivot about the axis A to contact the shaft 26 for a period of time. In this way, any contaminants on the shaft are wiped away by the brush 91 and the shaft 26 is simultaneously cleaned by the de-greaser 76.

By use of a highly volatile de-greaser such as trichloroethylene, further contamination of the turbine-generator system is prevented. As the de-greaser 76 removes the oil or dirt contamination, bearing lubricant oil 30 is supplied from the plant's lubricant supply system (not shown) can be further filtered to remove metal particles that may increase bearing arcing. Thus, the present invention provides an effective means for automatically conditioning the shaft grounding ground potential means 42 so as to prevent electrical discharge from occurring between the shaft 26 and the bearings 28, 38. Moreover, pitting of the bearings 28, 38, supported in part by contaminant metal particles in the bearing oil, is prevented by their being periodically removed by operation of the present invention.

While specific embodiments of the invention have been described in detail, it will be appreciated by those skilled in the art that various modifications and alterations would be developed in light of the overall teachings of the disclosure. Accordingly, the particular arrangements disclosed are meant to be illustrative only and not limiting as the scope of the invention, which is to be given the full breadth of the appended claims and in any and all equivalents thereof.

I claim:

1. An automatic shaft ground conditioning system comprising:

a rotating assembly having a shaft rotatable relative to a stationary assembly and subject to an electrical build-up during rotation, said shaft being supported by spaced apart bearings having an electrical insulating material associated therewith such that the shaft is electrically insulated from said bearings;

means for maintaining the shaft at substantially ground potential; and apparatus for automatically conditioning said grounding means so as to maintain effective contact between the shaft and said grounding means, whereby an electrical discharge is prevented from occurring between the shaft and said bearings.

2. The automatic shaft ground conditioning system of claim 1, wherein said apparatus for automatically conditioning said grounding means comprises spray means mounted adjacent said grounding means for applying a. cleansing material thereto for maintaining the shaft at substantially ground potential.

3. The automatic shaft ground conditioning system of claim 2, wherein said means for maintaining the shaft at substantially ground potential comprises a brush having a first end contacting the shaft, and a second end connected to a grounding source to provide a discharge path between the shaft and the grounding source.

4. The automatic shaft ground conditioning system of claim 2, wherein said means for maintaining the shaft at substantially ground potential comprises a first electrical device contacting the shaft for detecting a voltage thereon, a second electrical device in contact with the shaft, and a feedback circuit connected between said first and second electrical devices for providing a neutralizing current to the shaft through the second electrical device, said neutralizing current being a function of the voltage detected at the first electrical device.

5. The automatic shaft ground conditioning system of claim 2, further comprising a container of the de-greasing substance mounted adjacent said grounding means, and a solenoid actuator connected to the container so as to release a spray of the de-greasing substance from the container at said grounding means, the solenoid actuator being electrically connected to said grounding means such that the solenoid is actuated when said grounding means detects an excessive voltage on the shaft.

6. The automatic shaft ground conditioning system of claim 1, wherein said apparatus for automatically conditioning said grounding means comprises a container of the de-greasing substance disposed at a location remote from said grounding means, an actuator connected to the container so as to release an amount of the de-greasing substance from the container, the actuator being electrically connected to said grounding means such that the actuator is actuated when said grounding means detects an excessive voltage on the shaft, and a conduit for delivering the de-greasing substance to said grounding means for maintaining the shaft at substantially ground potential.

7. The automatic shaft ground conditioning system of claim 6, wherein said means for maintaining the shaft at substantially ground potential comprises a brush having a first end contacting the shaft, and a second end connected to a grounding source to provide a discharge path between the shaft and the grounding source.

8. The automatic shaft ground conditioning system of claim 6, wherein said means for maintaining the shaft at substantially ground potential comprises a first electrical device contacting the shaft for detecting a voltage thereon, a second electrical device in contact with the shaft, and a feedback circuit connected between said first and second electrical devices for providing a neutralizing current to the shaft through the second electrical device, said neutralizing current being a function of the voltage detected at the first electrical device.

9. The automatic shaft ground conditioning system of claim 1, wherein said apparatus for automatically conditioning said grounding means comprises a wiper arm mounted adjacent the shaft and an actuator operatively connected to the wiper arm, the actuator being electrically connected to said grounding means such that the wiper arm is caused to contact the shaft when said grounding means detects an excess voltage on the shaft.

10. An automatic shaft ground conditioning system comprising:

a rotating assembly having a shaft rotatable relative to a stationary assembly and subject to an electrical build-up during rotation, said shaft being supported by spaced apart bearings having an electrical insulation material associated therewith such that the shaft is electrically insulated from said bearings;

grounding means for maintaining the shaft at substantially ground potential operatively coupled to the shaft so as to provide an interface area between the shaft and said ground means; and apparatus for automatically conditioning said ground means comprising spray means mounted adjacent said ground means for applying a de-greasing substance adjacent the interface area for maintaining contact between the shaft and said ground means whereby an electrical discharge is prevented from occurring between the shaft and said bearings.

11. The automatic shaft ground conditioning system of claim 10, further comprising a container of the de-greasing substance mounted in close proximity to said grounding means, and a solenoid actuator connected to the container so as to release a spray of the de-greasing substance from the container at said grounding means, the solenoid actuator being electrically connected to said grounding means such that the solenoid is actuated when said grounding means detects an excessive voltage on the shaft.

12. The automatic shaft ground conditioning system of claim 11, wherein said means for maintaining the shaft at substantially ground potential comprises a brush having a first end contacting the shaft, and a second end connected to a grounding source to provide a discharge path between the shaft and the grounding source.

13. The automatic shaft ground conditioning . system of claim 11, wherein said means for maintaining the shaft at substantially ground potential comprises a first electrical device contacting the shaft for detecting a voltage thereon, a second electrical device in contact with the shaft, and feedback circuit means connected between said first and second electrical devices for providing a neutralizing current to the shaft through the second electrical device, said neutralizing current being a function of the voltage detected at the first electrical device.

14. The automatic shaft ground conditioning system of claim 10, wherein said apparatus for automatically conditioning said grounding means comprises a wiper arm mounted adjacent the shaft and an actuator operatively connected to the wiper arm, the actuator being electrically connected to said grounding means such that the wiper arm is caused to contact the shaft when said grounding means detects an excess voltage on the shaft.

15. A turbine-generator system comprising at least one steam turbine, a generator and an exciter for providing an electric field current to the generator, wherein the turbine, generator and exciter are operatively engaged with a rotating shaft, the shaft being supported by at least one bearing assembly supported by a bearing pedestal, said bearing having an electrical insulating material associated therewith such that the shaft is electrically insulated from said bearing assembly, the shaft and bearing assembly being subject to an electrical charge build-up during rotation of the shaft, a grounding device operatively connected between the shaft and the bearing pedestal so as to provide an interface area between the shaft and the grounding device, and apparatus for automatically conditioning the grounding device comprising spray means for applying a de-greasing substance adjacent the interface area for maintaining contact between the shaft and the grounding device whereby an electrical discharge is prevented from occurring between the shaft an said bearings.

16. The turbine-generator system of claim 15, . wherein the grounding device comprises a brush having a first end contacting the shaft, and a second end electrically connected to the bearing pedestal to provide a discharge path between the shaft and the bearing pedestal.

17. The turbine-generator system of claim 15, wherein the grounding device comprises a first electrical device contacting the shaft for detecting a voltage thereon, a second electrical device in contact with the shaft, and a feedback circuit connected between said first and second electrical devices for providing a neutralizing current to the shaft through the second electrical device, said neutralizing current being a function of the voltage detected at the first electrical device.

18. The turbine generator system of claim 15, wherein said apparatus for automatically conditioning said grounding means comprises a wiper arm mounted adjacent the shaft and an actuator operatively connected to the wiper arm, the actuator being electrically connected to said grounding means such that the wiper arm is caused to contact the shaft when said grounding means detects an excess voltage on the shaft.

* * * * *